US005626074A

United States Patent [19]

Zelko

[11] Patent Number: 5,626,074

[45] Date of Patent: May 6, 1997

[54] SCREEN PRINTING MACHINE

[76] Inventor: Steve Zelko, 1907 Triumph Street, Vancouver, British Columbia, Canada, V5L 1K6

[21] Appl. No.: 529,860

[22] Filed: Sep. 18, 1995

Related U.S. Application Data

[63] Continuation of Ser. No. 138,074, Oct. 20, 1993, abandoned.

[51] Int. Cl.[6] ..... B41F 15/04

[52] U.S. Cl. ..... 101/115; 101/123; 101/126

[58] Field of Search ..... 101/115, 123, 101/124, 126, 127.1, 128, 128.1

[56] References Cited

U.S. PATENT DOCUMENTS

| | | | |
|---|---|---|---|
| 2,783,709 | 3/1957 | Thomas | 101/123 |
| 4,068,994 | 1/1978 | Cadwallader et al. | 101/126 X |
| 4,099,460 | 7/1978 | Bubley et al. | 101/115 X |
| 4,724,760 | 2/1988 | Bubley | 101/115 |
| 4,753,162 | 6/1988 | Bubley | 101/115 |
| 4,939,991 | 7/1990 | Szarka | 101/115 |
| 4,962,702 | 10/1990 | Eppinger | 101/114 |
| 4,974,507 | 12/1990 | Eppinger | 101/115 |

OTHER PUBLICATIONS

"Champrint Automatic Textile Printer", Advance American Equipment Oct. 3, 1990.

*Primary Examiner*—Christopher A. Bennett
*Attorney, Agent, or Firm*—Long and Cameron

[57] ABSTRACT

A screen printing machine has a bearing supporting a first arm structure for rotation about a vertical axis, the first arm structure comprising first arms equiangularly distributed about the vertical axis and extending radially outwardly of the vertical axis. The first arms each carry, at a free outer end thereof, a printing screen support platen. A second arm structure has second arms equiangularly distributed about the vertical axis and extending radially outwardly of the vertical axis, the second arms each carrying, at a free outer end thereof, a squeegee mechanism and a printing screen support for holding printing screen below the squeegee mechanism. An indexing drive rotates the first arm structure stepwise around the vertical axis so as to position the platens in succession in registry with the squeegee mechanisms; and interengageable pairs of connectors are provided on the first and second arms for forcibly connecting the first arms to the second arms, to counteract bending of the arms during the operation of the squeegee mechanisms.

21 Claims, 16 Drawing Sheets

SCREEN PRINTING MACHINE

This application is a continuation of application Ser. No. 08/138,074, filed Oct. 20, 1993 now abandoned.

BACKGROUND OF THE INVENTION

1. Field of the Invention

The present invention relates to screen printing machines and is useful, in particular, for rotary machines for printing on T-shirts and the like.

2. Description of the Related Art

It has previously been proposed to construct a screen printing machine, for printing T-shirts, having a first set of arms extending radially outwardly of a central, vertical axis and carrying, at their free ends, platens for supporting T-shirts, with a second set of radially extending arms located above the first set. An indexing mechanism rotates the first set of arms, in a stepped manner, so that each of the first arms is brought, in succession, beneath each of the second arms.

The free ends of the second arms carry printing screen holders for gripping and retaining printing screens, together with squeegee mechanisms located above the printing screen holders for performing a squeegee action on the printing screens.

In operation of such a device, the T-shirts are fitted over the platens and the first set of arms are then rotated to bring each T-shirt beneath each of the printing screens, in succession. The rotation of the first set of arms is interrupted, after each step in the rotation, and the first set of arms are then raised so as to press the T-shirts against the undersides of the screens, whereupon the squeegee mechanisms are operated.

BRIEF SUMMARY OF THE INVENTION

It is an objection of the present invention to provide a novel and improved screen printing machine of the above-described type provided with connectors operable to simply and temporarily connect the first and second arms to counteract bending of the arms.

According to the present invention, there is provided a screen printing machine comprising the bearing arrangements supporting a first arm structure for rotating about a vertical axis, the first arm structure comprising first arms equiangularly distributed about the vertical axis and extending radially outwardly of the vertical axis. Each of the first arms carries, at a free outer end thereof, a printing screen support platen. The machine includes a second arm structure comprising second arms equiangularly distributed above the vertical axis and extending radially outwardly of the vertical axis, the second arms each carrying, at a free outer end thereof, a squeegee mechanism and a printing screen support for holding a printing screen below the squeegee mechanism.

An indexing mechanism rotates the first arm structure stepwise around the vertical axis so as to position the platens in succession in registry with the squeegee mechanisms.

Interengageable pairs of connectors provided of the first and second arms, at locations adjacent and radially inward of the printing screen supports, are operable to forcibly connect the first arms to the second arms, and thereby to counteract bending of the arms, during the operation of the squeegee mechanisms.

The squeegee mechanisms each comprise a squeegee for sliding contact with a printing screen and a carriage carrying the squeegee for movement to and fro over the printing screen. The squeegee has a pair of mutually angularly displaced squeegee blades and a pivotal connection is provided between the squeegee and the carriage for permitting pivotation of the squeegee about an axis parallel to the squeegee blades for bringing the squeegee blades alternately into contact with the printing screen during the to and fro moments, respectively, of the carriage. A piston and cylinder device mounted on the carriage is connected to the carriage and the squeegee for effecting pivotation of the squeegee about the axis, and an adjustable stop mechanism adjustably limits the pivotation of the squeegee by the piston and cylinder device.

A vertically adjustable connection is provided between the squeegee and the carriage and comprises a cylindrical threaded member extending downwardly from the carriage, a manually rotatable adjustment ring member in threaded engagement with the cylindrical threaded member, and a slide member carrying the squeegee, the slide member being supported on the ring member for vertical displacement upon rotation of the ring member about the cylindrical threaded member.

A piston rod and cylinder device has a piston rod connected to the squeegee carriage for effecting to and fro movement of the squeegee over the printing screen and an air brake is provided for braking such movement. The air brake comprises a pair of brake members formed with cylindrically curved braking surfaces and air passages for supplying compressed air to the brake members so as to urge the braking surfaces into frictional braking contact with opposite sides of the piston rod.

The machine includes a lifting device for raising the first arm structure towards the second arm structure, a stop for limiting the upward movement of the first arm structure towards the second arm structure and a height adjustment mechanism for adjustably raising and lowering the stop and thereby adjusting the limit of the upward movement of said first arm structure. The height adjustment mechanism includes a manually adjustable member accessible from the exterior of the machine.

A shock absorber is connected to the first arm structure for damping the stepwise rotation of said first arm structure by the indexing drive and comprises an elongate piston slidable to and fro in a cylinder and a plurality of fluid outlet openings spaced apart along the cylinder for permitting hydraulic fluid to escape from the cylinder in response to sliding of the piston within the cylinder towards one end of the cylinder. The piston is dimensioned to successively block the outlet openings as the piston slides into the cylinders.

The indexing mechanism comprises an indexing arm mounted for pivotation about the vertical axis, a piston and cylinder device connected between the indexing arm and the machine frame for effecting the pivotation of the indexing arm, a connector member at a free end of the indexing arm and an actuator for raising the connector member into drive transmitting engagement with successive ones of the first arms.

The printing screen supports each comprise a screen holder for holding a printing screen, a support structure carrying the screen holder, and an adjustment mechanism between the support structure and the respective one of the second arms, the adjustment mechanism being operable to adjustably displace the support structure longitudinally and transversely of its second arm.

The screen holder comprises a pair of spaced screen supports for supporting opposite edges of the printing screen and the support structure is provided with adjustable connectors between the screen supports and the support structure to allow the screen supports to be adjusted in position relative to one another and to the support structure.

The second arms each comprising first arm member extending radially outwardly of the vertical axis, a second arm member extending radially outwardly of the vertical axis and downwardly and outwardly inclined towards the first arm member, releasable fasteners for securing the second arm member to the first arm member and an adjustment mechanism for adjusting the second arm member in position along the first arm member while the fasteners are released.

BRIEF DESCRIPTION OF THE DRAWINGS

Further features, advantages and objects of the present invention will be more readily apparent to those skilled in the art from the following description thereof when taken in conjunction with the accompanying drawings, in which.

THE PREFERRED EMBODIMENT

Figure 1:
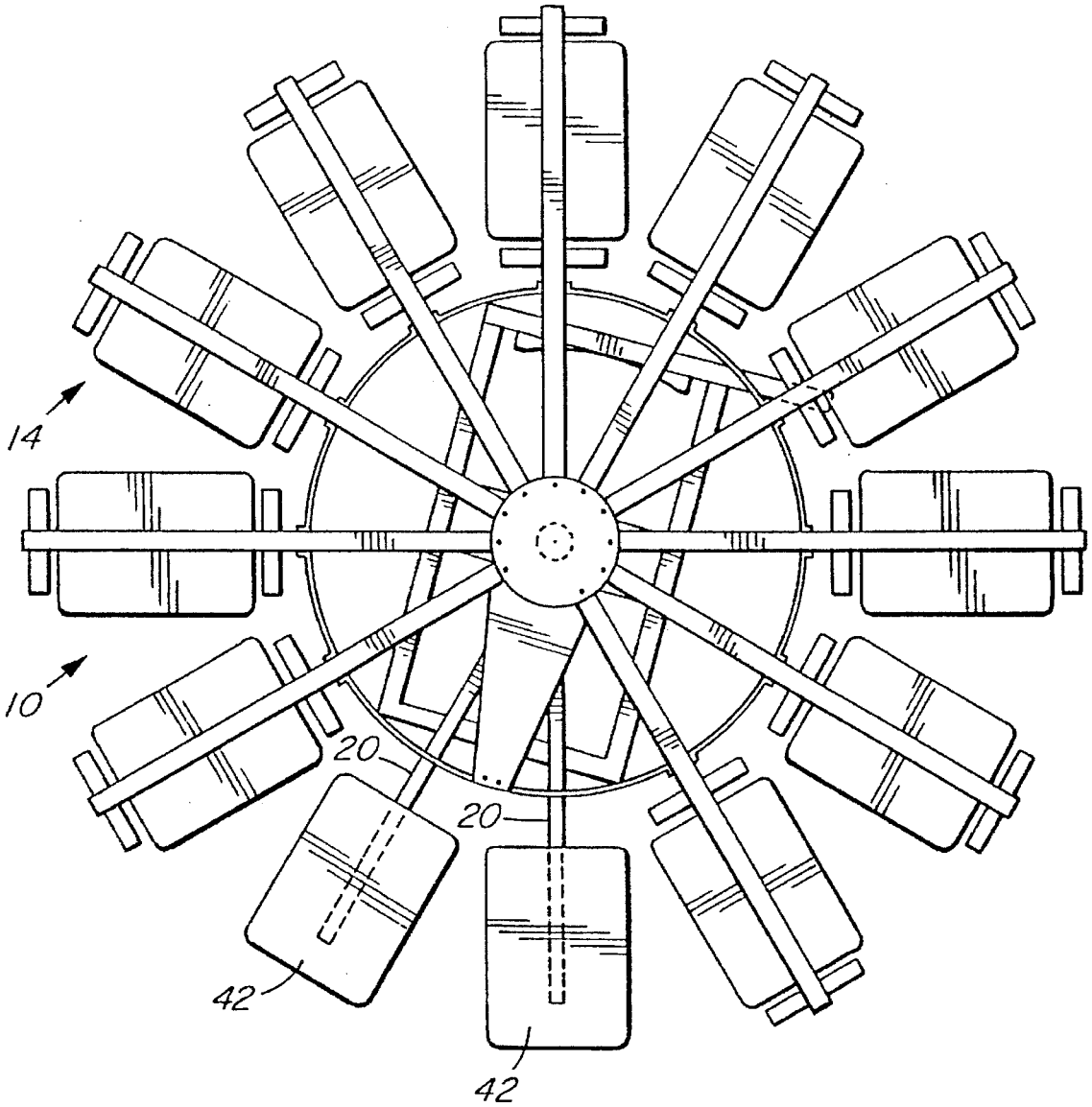
FIG. 1 shows a plan view of a rotary screen printing machine according to the present invention.
Figure 2:
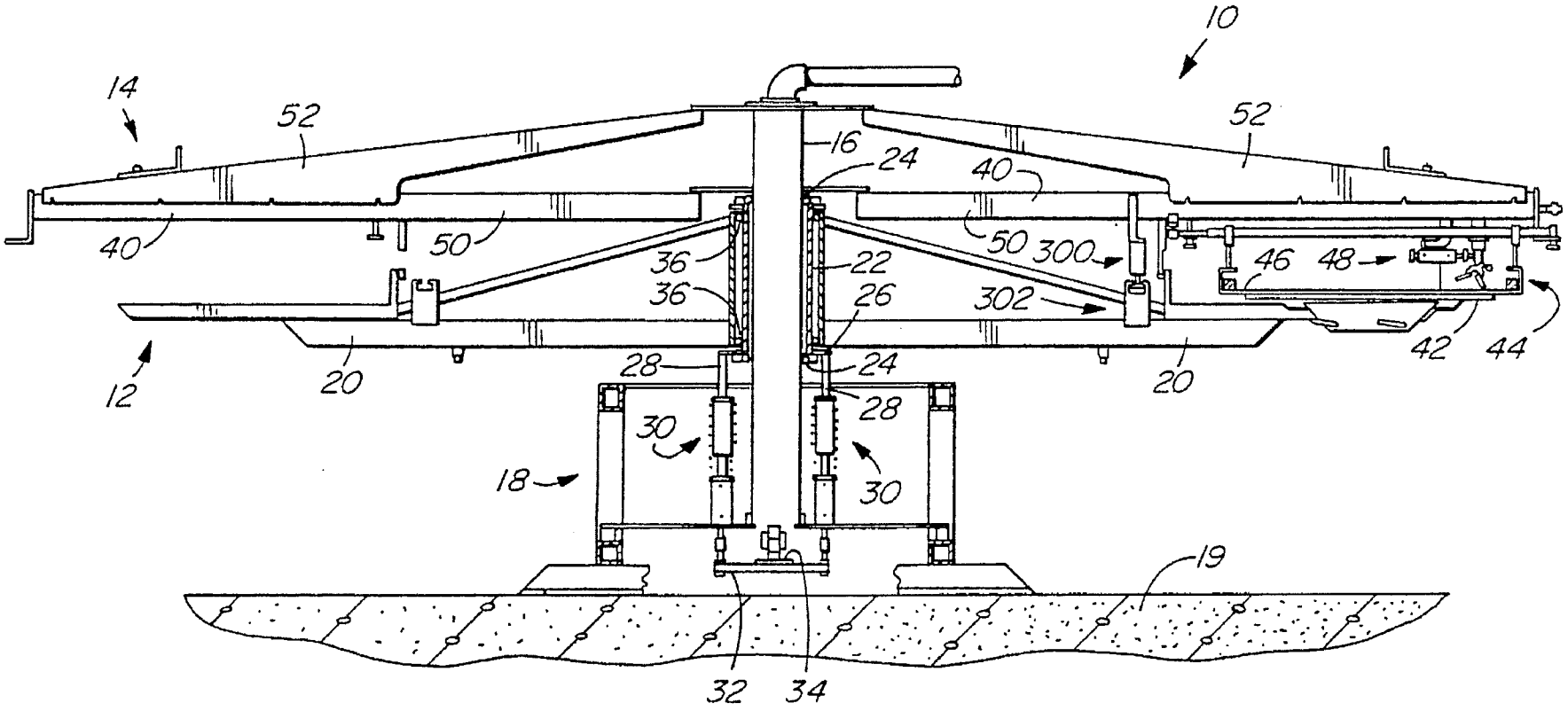
FIG. 2 shows a view taken in vertical cross-section through the machine of FIG. 1.

FIGS. 1 and 2 show a rotary printing machine indicated generally by reference numeral 10, which has a first or lower arm structure indicated generally reference numeral 12 and a second or upper arm structure indicated generally by reference numeral 14.

The second arm structure 14 is stationary and is mounted above the first arm structure 12 on a central, vertical cylindrical column or support 16, which, in turn, is fixably connected to a machine frame indicated generally by reference numeral 18, said column 16 and said machine frame 18 forming a support structure which serves to support the entire printing machine 10 on a floor 19.

The first arm structure 12 comprises twelve generally horizontally extending first arms, two of which are indicated by reference numerals 20, which are equiangularly spaced about the vertical longitudinal axis of the cylindrical support 16 and which extend radially outwardly of this vertical axis.

The first arm structure 12 is carried on a sleeve 22, which is co-axial with the cylindrical support 12 and which is supported for movement to and fro, in the vertical direction, along the exterior of the cylindrical support 16 by means of rollers 24 in rolling engagement with the outer surface of the cylindrical support 16.

The lower end of the sleeve 22 is provided with a radially outwardly extending flange 26, which is carried on the upper ends of two piston rods 28.

The piston rods 28 form parts of a lifting device connected between the first arm structure 12 and the support structure and operable to displace the former to and from a raised position, the lifting device comprising vertically acting piston and cylinder devices indicated generally by reference numerals 30, the cylinders of which are fixed to the machine frame 18.

A horizontal bar 32 connects the lower ends of the piston rods 28, and extends below a stop in the form of a pad 34 mounted on the support structure for limiting the upward movement of the first arm structure 12 towards the second arm structure 14. The arrangement is such that, on expansion of the piston and cylinder devices 30 in order to raise the sleeve 22 and, thereby, the entire first arm structure 12, into a raised position relative to the cylindrical support 16 and the second arm structure 14, the upward movement of the first arm structure 12 is limited by abutment of the bar 32 against the pad 34.

The first arm structure 12 is supported on the sleeve 22 by means of a bearing arrangement co-axial with the vertical support 16 and comprising bearings 36 so as to be rotatable about the common vertical axis of the sleeve 22 and the cylindrical support 16.

The second arm structure 14 comprises twelve arms 40, which are equiangularly distributed around, and extend radially of, the vertical axis of the cylindrical support 16.

At their free outer ends, the first arms 20 each carry a printing screen support platen 42, whereas the second arms 40 each carry, at their outer free end, a printing screen holder indicated generally reference numeral 44, for holding a printing screen 46, and a squeegee mechanism indicated generally by reference numeral 48, the printing screens 46 thus being held below the squeegee mechanisms.

The second arms 40 each comprise a substantially horizontally extending first arm member 50, which is connected at its inner end to the cylindrical support 16, and an inclined second arm member 52, which extends above the respective first arm member 50 and which is radially outwardly and downwardly inclined to the respective first arm member 50, the inner end of the second arm member 52 being connected to the top of the cylindrical support 16.

Figure 3:
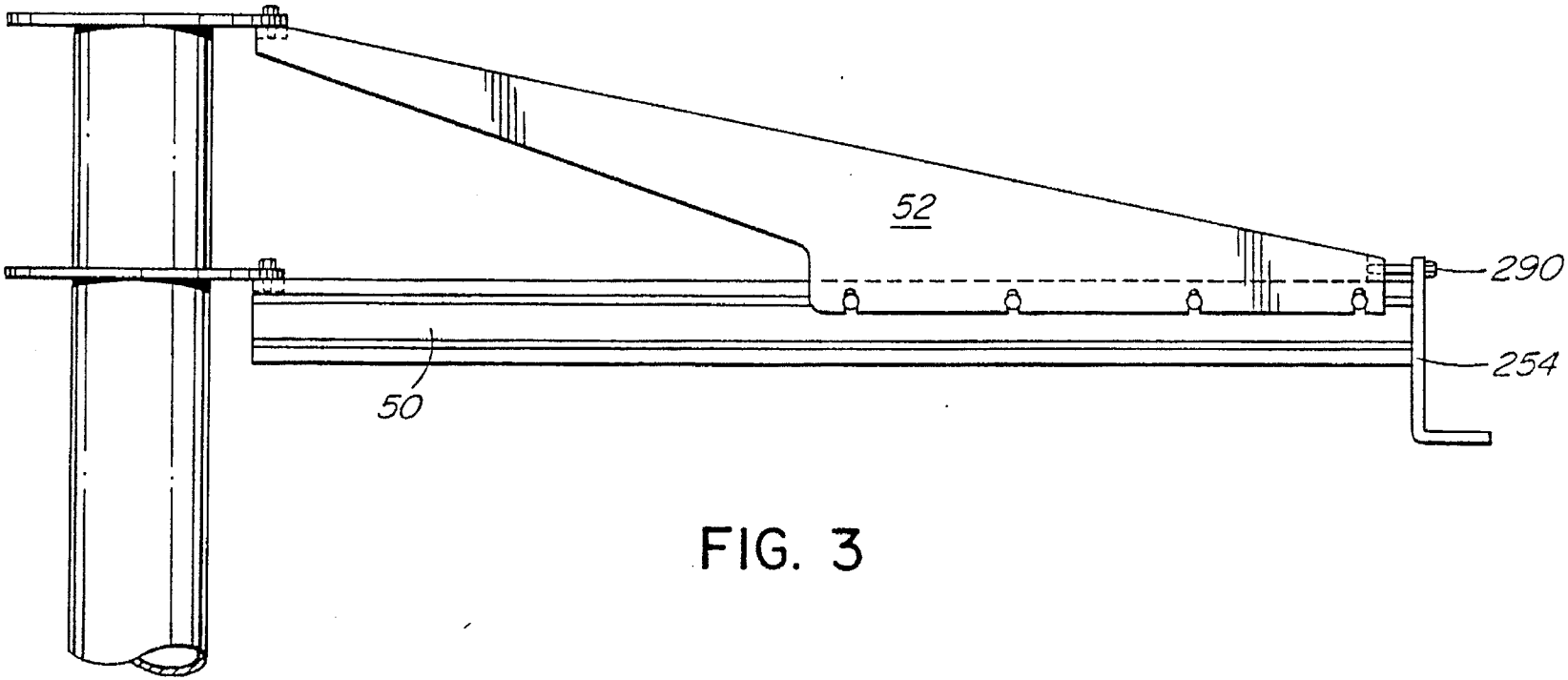
FIG. 3 shows a view in side elevation of an arm forming part of the screen printing machine of FIG. 1.
Figure 4:
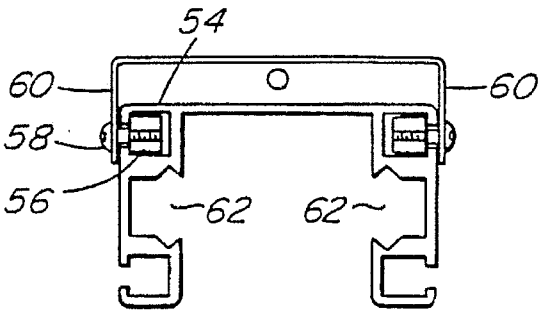
FIG. 4 shows a view taken in cross-section along the line 4—4 of FIG. 3.

More particularly, as illustrated in FIGS. 3 and 4, the arm member 50 is in the form of an extrusion, which has, at opposite sides, upper longitudinal recesses 54 containing square nuts 56, which are in threaded engagement with bolts 58 extending through slots in the extrusion 50 and in opposite side walls 60 of the arm member 52. By tightening the bolts 58, the side walls 60 can be clamped to opposite sides of the extrusion 50.

Figure 7:
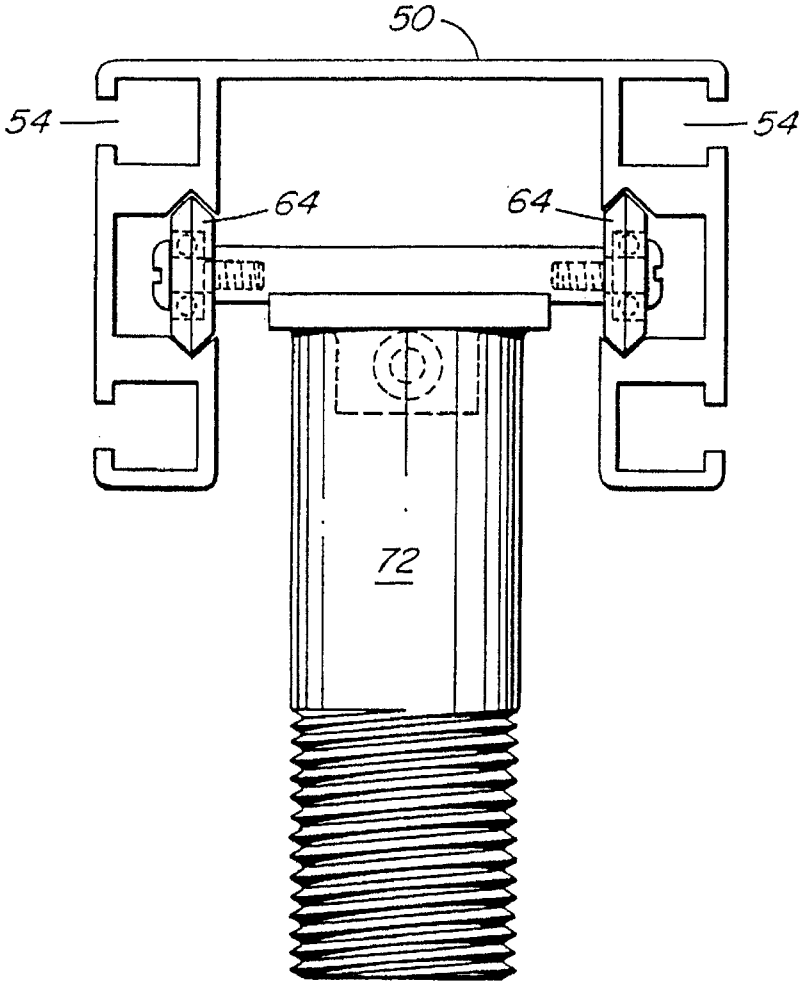
FIG. 7 shows a view in end elevation of the squeegee mechanism parts of FIG. 6 and of part of an arm of the printing machine of FIG. 1.

The extrusion 50 is also formed with a pair of opposed raceways 62 which, as illustrated in FIG. 7, form a track for rollers 64.

Figure 5:
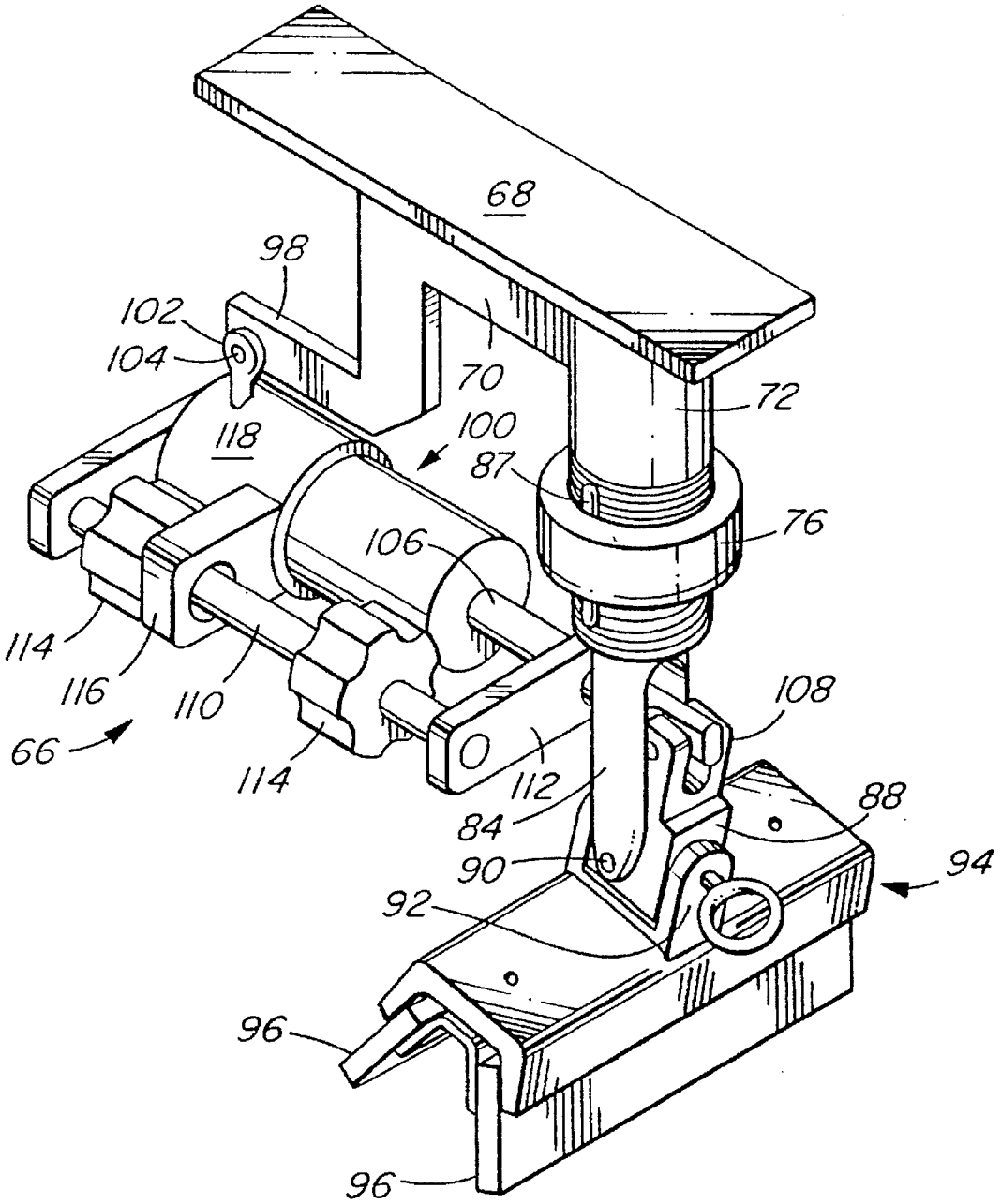
FIG. 5 shows a view in perspective of parts of a squeegee mechanism of the machine of FIG. 1.
Figure 6:
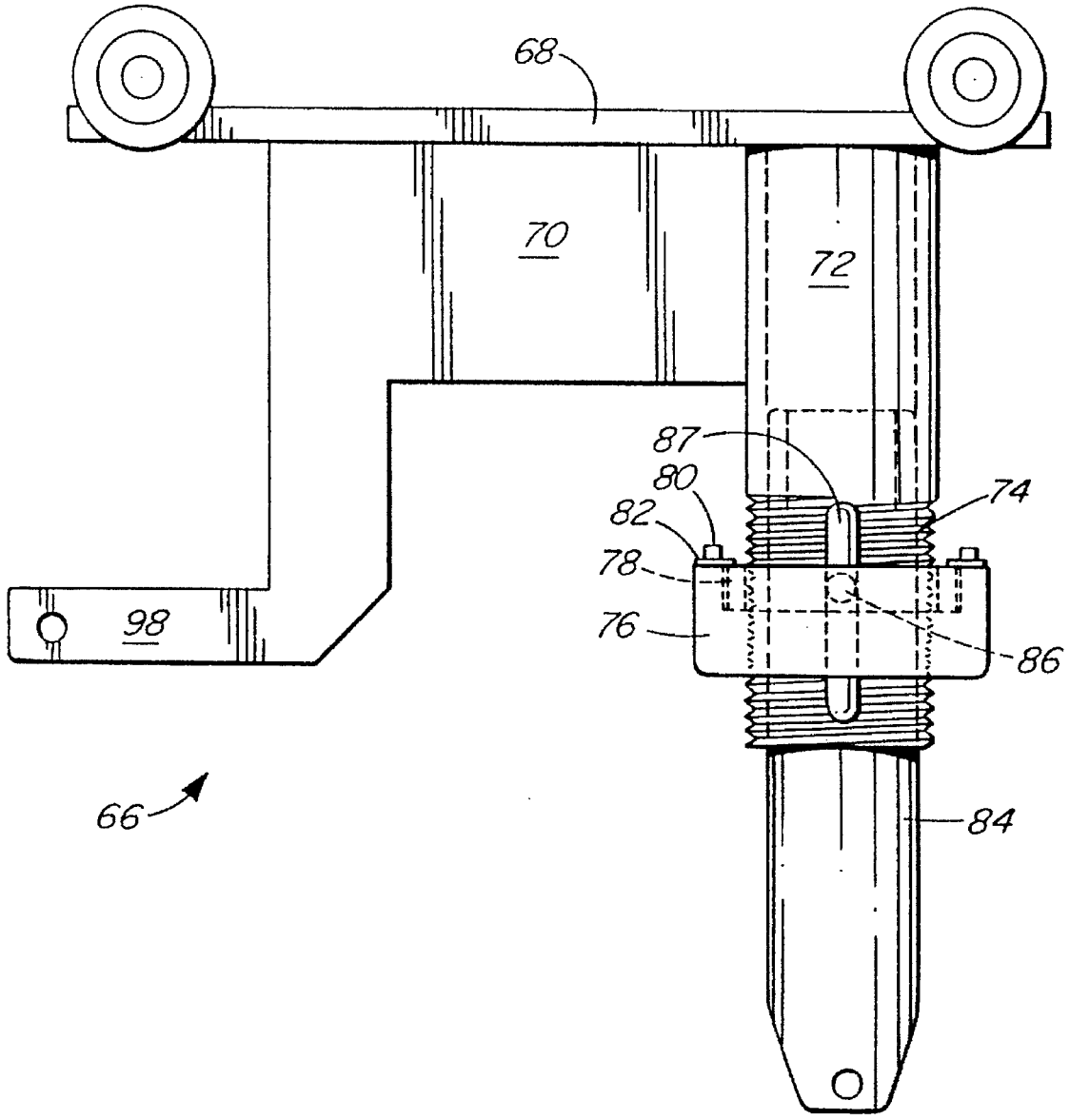
FIG. 6 shows a view in side elevation of parts of the squeegee mechanism of FIG. 5.
Figure 8:
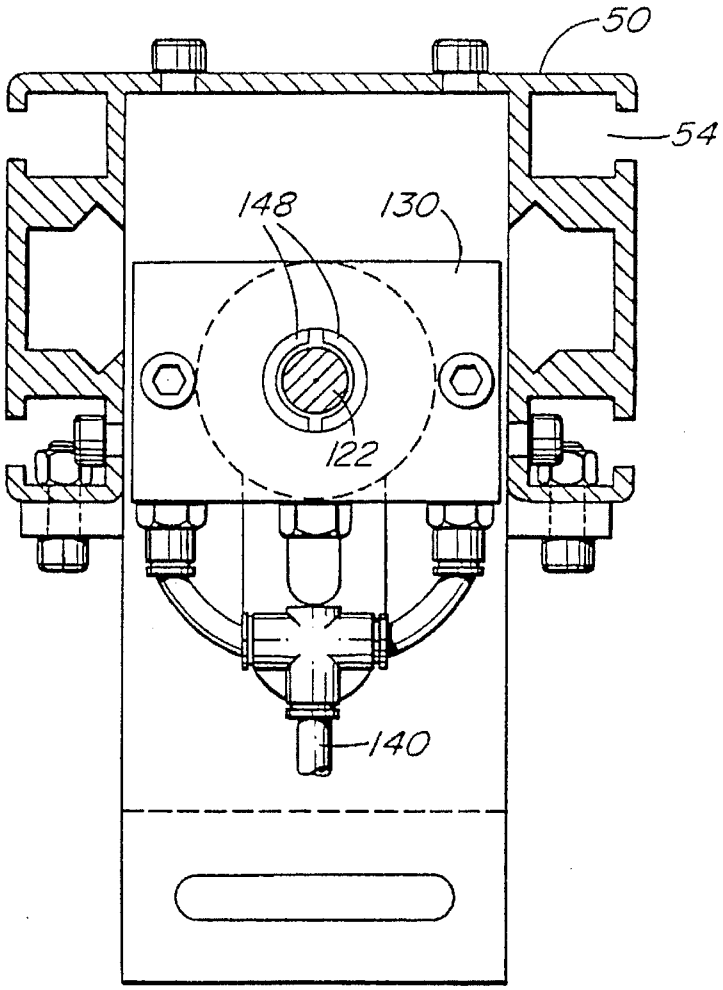
FIG. 8 shows a view taken in cross-section along the line 8—8 of FIG. 9.

The rollers 64 carry the squeegee mechanism 48, which includes a squeegee carriage indicated generally reference numeral 66 in FIGS. 5 and 6, the rollers 64 being omitted from FIG. 5 to facilitate the illustration.

The raceways 62, the rollers 64 and the carriage 66 form a suspension arrangement supporting a squeegee 94 (FIG. 5) for movement to and fro over the printing screen 46, as described in greater detail below.

The squeegee carriage 66 is formed by a horizontal plate 68, a vertical plate 70 depending from the plate 68 and a sleeve 72, which also depends from the plate 68.

The lower end of the sleeve 72 is formed with a screw thread 74, which is in threaded engagement with a corresponding internal screw thread in an adjustment ring 76. The adjustment ring 76 contains an inner ring 78, which extends around the sleeve 72 and which is retained in an annular recess in the adjustment ring 76 by means of retaining screws 80 and washers 82.

A cylindrical yoke 84 has an upper end slidably received in the sleeve 72, and is supported by means of a transverse pin 86, opposite ends of which engage in the ring 78. The pin 86 is a slide member slidable along vertical slots, one of which is indicated by reference numeral 87 and which extend through opposite sides of the sleeve 72. By rotation of the adjustment ring 76 relative to the sleeve 72, the inner ring 78 and, therewith, the yoke 84 are vertically adjusted in position relative to the sleeve 72.

A rocker member 88 is pivotally supported in the yoke 84 by means of a pivot pin 90 so as to be pivotable to and fro about the pin 90. The rocker member 88 is connected by a connecting bracket 92 to a squeegee indicated generally by reference numeral 94, which has a pair of mutually angularly disposed squeegee blades 96.

The pivot pin 90 forms a pivotal connection between the squeegee 94 and the carriage 66, permitting pivotation of the squeegee about an axis, i.e. the pivot axis of the pivot pin 90, parallel to the squeegee blades 96.

The squeegee carriage vertical plate 70 has a horizontally rearwardly extending arm 98, to which a pneumatic piston and cylinder device indicated generally by reference numeral 100 is connected by means of an eye-bolt 102 and a pivot pin 104. The piston and cylinder device 100 has a piston rod 106, the free end of which is pivotally connected to a forked part 108 of the rocker member 88 and, thus, to the squeegee 94.

An elongate member in the form of a slide rod 110 is connected at its opposite ends, by metal bars 112, to the piston rod 106 so as to be movable to and fro therewith. The rod 110 carries a pair of stop members comprising adjustment nuts 114, which are in threaded engagement with the rod 110, and the rod 110 extends through a circular opening in an abutment 116, which is fixed to cylinder 118 of the piston and cylinder device 100. By rotatably adjusting the nuts 114 in position along the length of the rod 110, the limits of the to and fro movement of the piston 106 can be adjusted and, thus, the angle through which the squeegee 94 is pivoted by the operation of the piston and cylinder device 100 is likewise adjusted.

Figure 9:
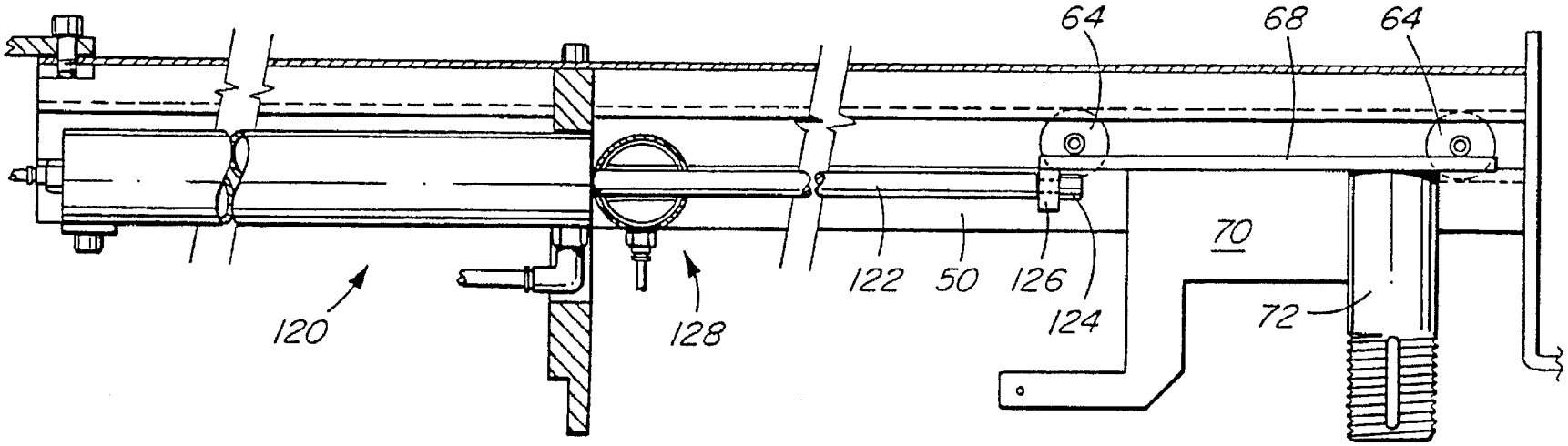
FIG. 9 shows a view taken in vertical cross-section through part of an arm of the machine of FIG. 1.

The squeegee carriage 66 is driven to and fro along the arm member 50 by means of a piston and cylinder device indicated generally by reference numeral 120 in FIG. 9. The piston and cylinder device 120 has a piston rod 122, which is secured by a knurled retaining bolt 124 to a bracket 126 which depends from the rear end of the squeegee carriage horizontal plate 68.

Figure 11:
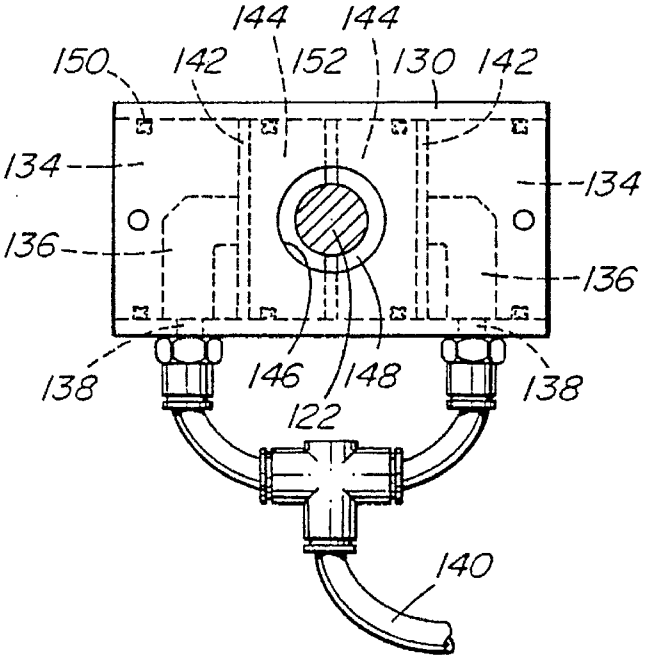
FIG. 11 shows a view in front elevation of the air brake of FIG. 10.
Figure 10:
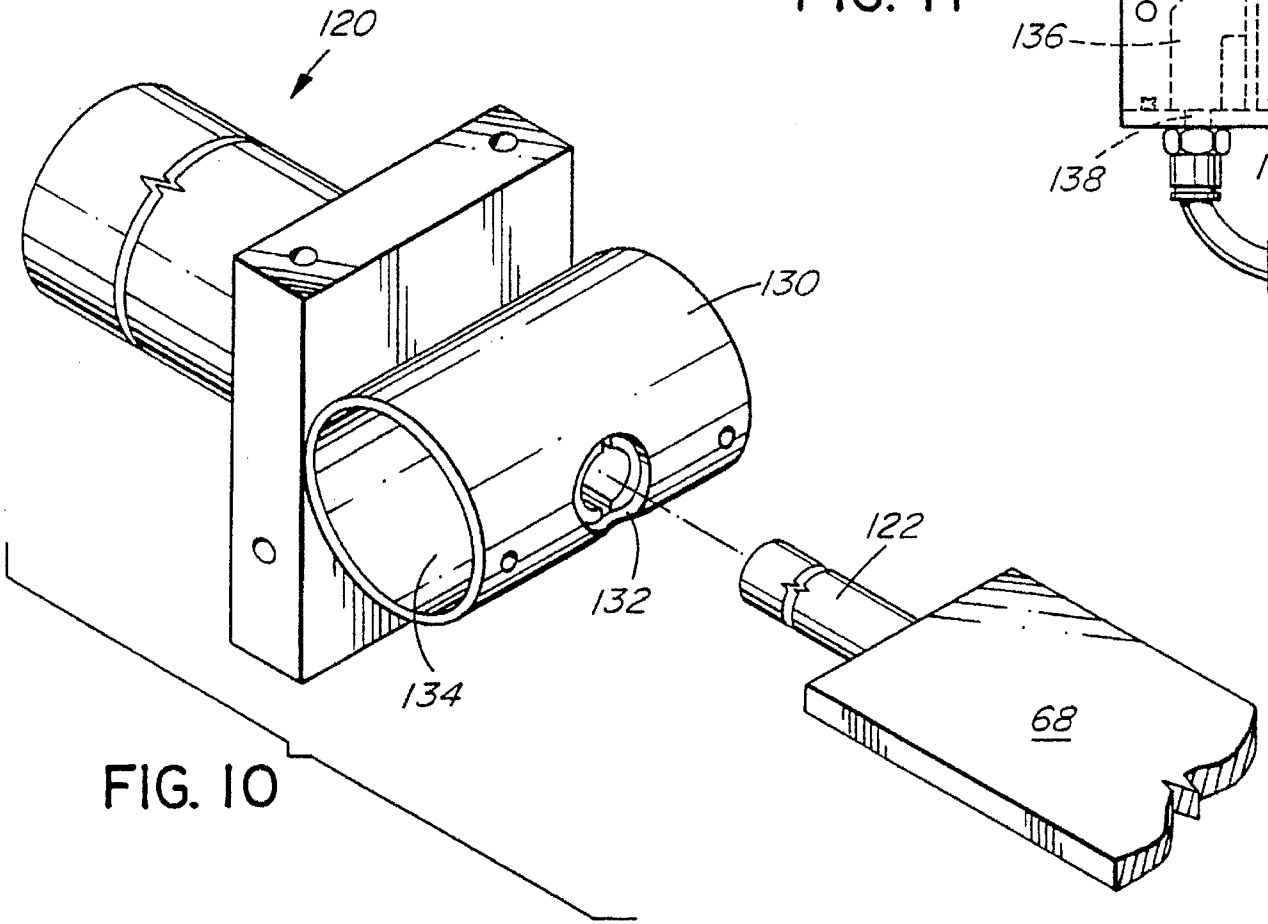
FIG. 10 shows a view in perspective of an air brake.

The piston rod 122 extends through an air brake which is indicated generally by reference numeral 128 and which is shown in greater detail in FIGS. 10 and 11.

The air brake 128 has a cylindrical housing 130, which is provided at opposite sides with circular openings, one of which is indicated by reference numeral 132, through which the piston rod 122 extends.

Opposite ends of the cylindrical housing 130 are closed by a pair of solid cylindrical metal plugs 134 (FIG. 11), which are formed with air passages 136. Each air passage 136 communicates through a circular opening 138 in the bottom of the cylindrical housing 130 with a compressed air supply tube 140, and also communicates with a cylinder space 142 within the cylindrical housing 130 between the two cylindrical plugs 134.

The cylinder space 142 contains a pair of pistons 144, which are provided at opposite sides of the piston rod 122 and which are formed with opposed semi-cylindrical recesses 146 containing cylindrically curved brake members 148, which are in sliding contact with opposite sides of the piston rod 122. The brake members 148 are made of graphite-impregnated nylon.

O-ring seals 150 and 152 are provided between the metal plugs 134 and the pistons 144, on one hand, and the internal cylindrical surface of the cylindrical housing 130, on the other hand.

In operation of this air brake, compressed air is supplied through the air passages 136 and acts on the pistons 144 so as to press the brake members 148 against the piston rod 122 and, thereby, to brake the movement of the squeegee carriage 66 as the latter approaches the opposite ends of its path of movement.

Figure 12:
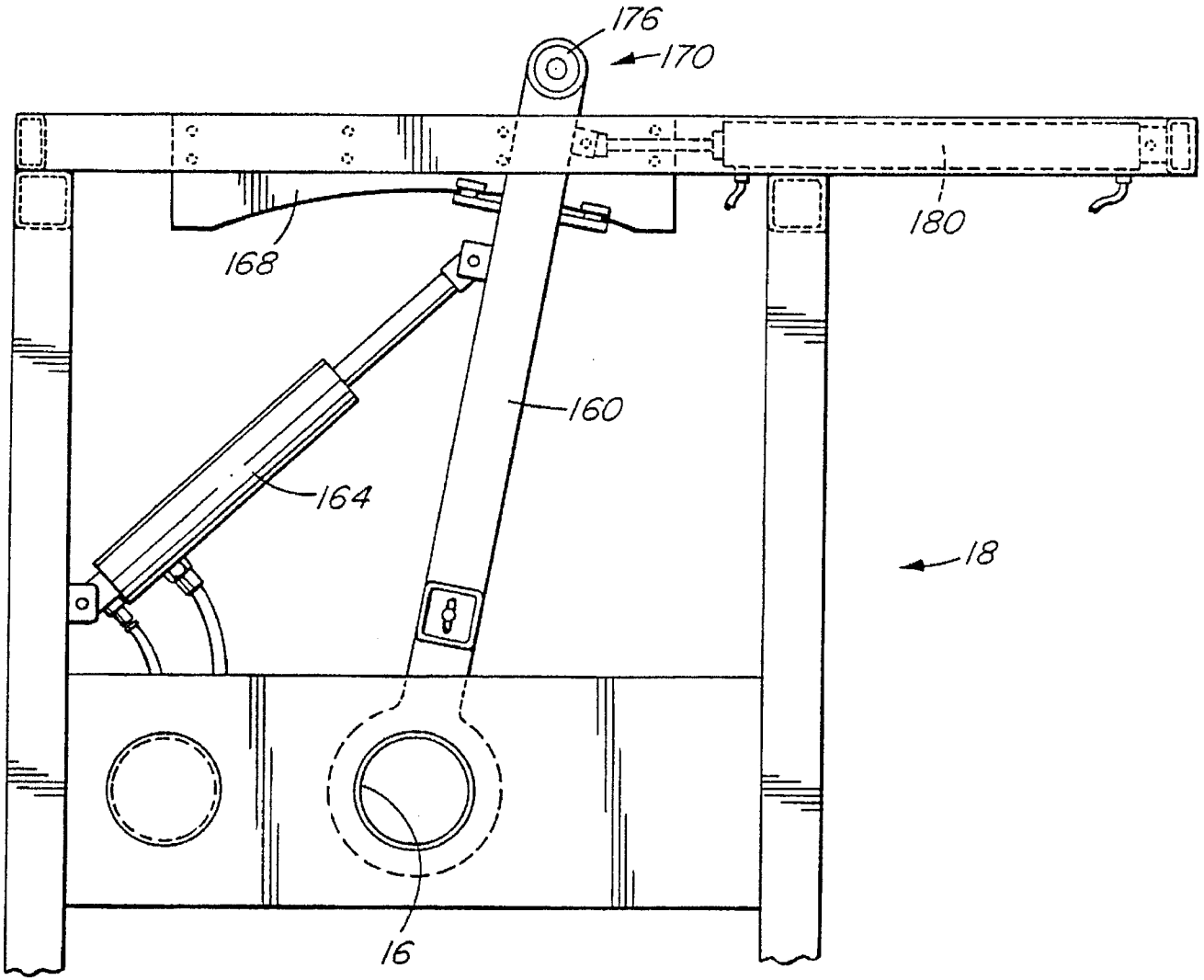
FIG. 12 shows a broken-away view of an indexing mechanism and other parts of the machine of FIG. 1.
Figure 13:
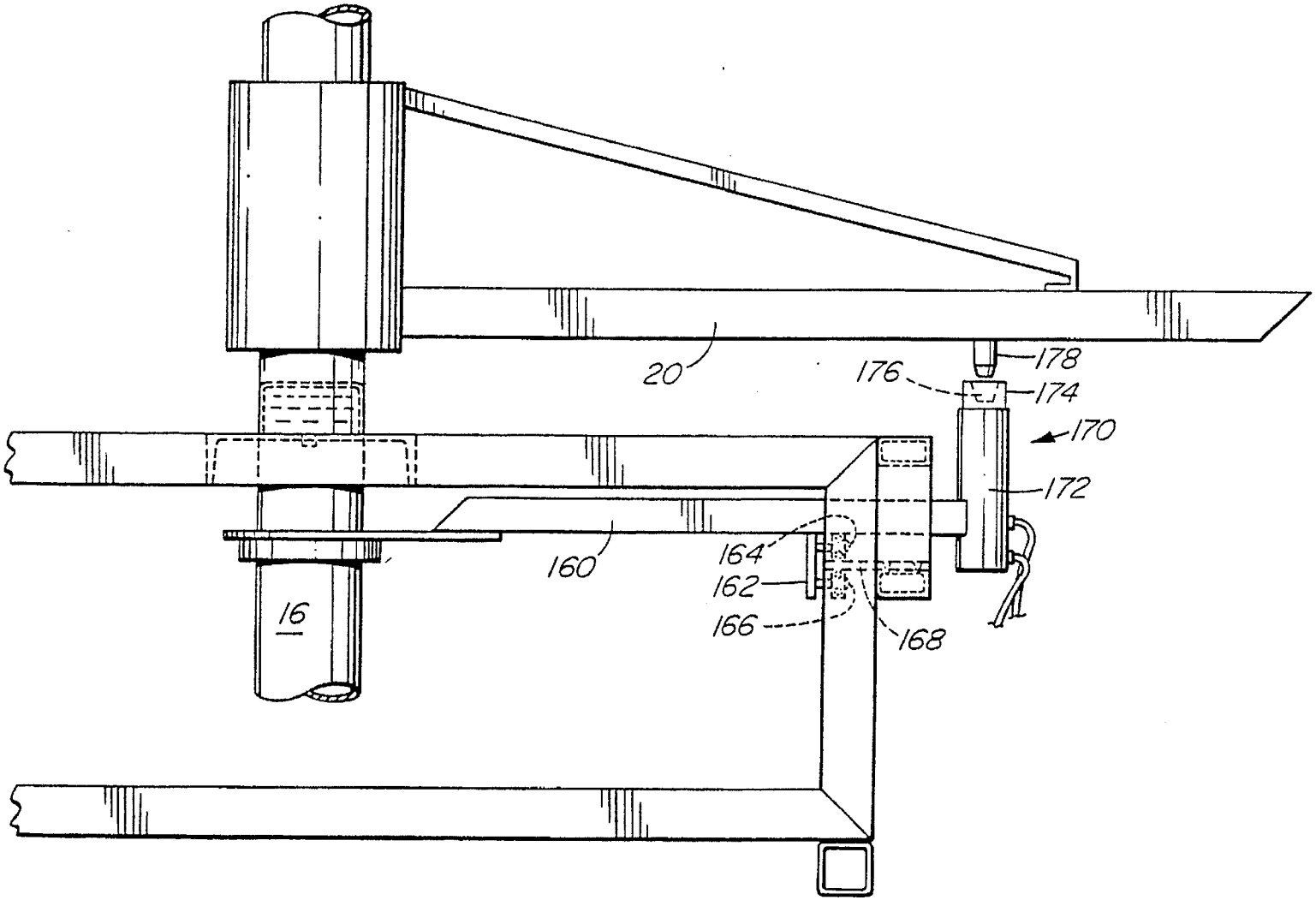
FIG. 13 shows a broken-away view in side elevation of the indexing mechanism of FIG. 12 and other parts of the machine of FIG. 1.
Figure 14:
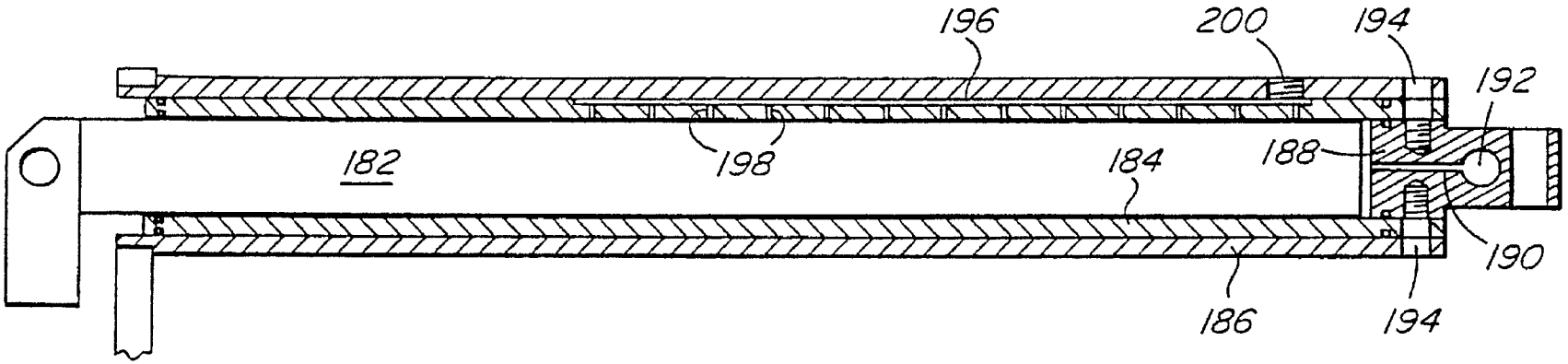
FIG. 14 shows a view in longitudinal cross-section through a shock absorber forming part of the indexing mechanism of FIG. 12.

Reference is now made to FIGS. 12 through 14, which illustrate components of an indexing mechanism connected between the first arm structure 12 and the support structure comprising the machine frame 18 for effecting the stepwise rotation of the first arm structure 12 around the vertical axis of the cylindrical support 16 so as to position the platens 42 in succession in registry with the squeegee mechanisms 48.

The indexing mechanism comprises an indexing arm 160, which is pivotable to and fro about the cylindrical column 16.

A pneumatic piston and cylinder device 164 is pivotally connected to the machine frame 18 and to the indexing arm 160 for effecting the pivotation of the latter.

The indexing arm 160 is provided, at its underside, with a downwardly extending plate 162, carrying upper and lower rollers 164 and 166 which are in rolling engagement with the upper and lower surfaces, respectively, of an arcuately curved support plate 168 mounted on the machine frame 18 for counteracting bending of the indexing arm 160.

At its free end, the indexing arm 160 carries a connector device indicated generally by reference numeral 170, which has a cylindrical housing 172 containing a connector member in the form of a cylindrical socket 174, which is provided at its top with a socket recess 176. In response to a supply of compressed air to the connector 170, the socket member 174 is displaced upwardly into driving engagement with a correspondingly shaped pin 178 extending downwardly from the first arm 20, as shown in FIG. 13.

Each of the first arms 20 of the first arm structure 12 is provided with one of the pins 178, so that the arms 20 can be drivingly engaged and displaced, in succession, by operation of the indexing mechanism.

Figure 13A:
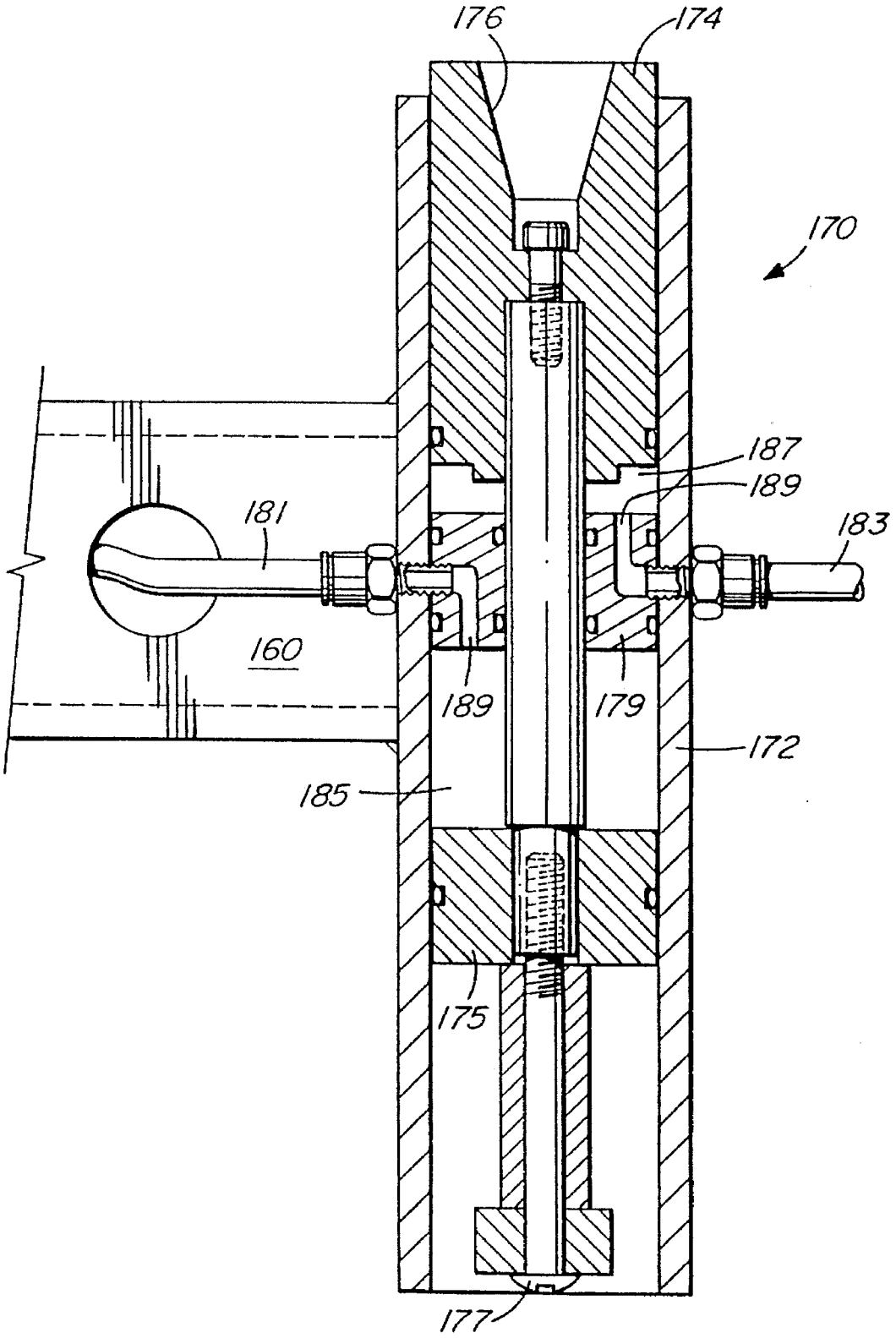
FIG. 13A shows a view taken in vertical cross-section through a connector device forming part of the apparatus of FIGS. 12 and 13.

As can be seen from FIG. 13A, the socket 174 forms a piston which is vertically slidable in the cylindrical housing 172 and which is connected by a rod 173 to another piston 175, which is also vertically slidable in the housing 172. The piston 175 is retained on the lower end of the rod 173 by a retaining bolt 177, and the rod 173 is slidable through a cylindrical block 179 which is fixedly positioned in the housing 172. Pneumatic tubes 181 and 183 communicate with chambers 185 and 187 at opposite sides of the block 179, through passages 189 in the block 179, so that the vertical displacement of the socket 174 into end out of engagement with the pins 178 can be effected pneumatically.

The pivotation of the indexing arm 160 for drawing the first arm structure 12, and thus each step of the rotation of the first arm structure 12 by the indexing mechanism, are damped by means of a shock absorber 180 which, as illustrated in FIG. 12, is connected between the machine frame 18 and an outer end portion of the indexing arm 160.

The construction of the shock absorber 180 is illustrated in greater detail in FIG. 14, from which it can be seen that the shock absorber 180 has an elongate piston 182, which is slidable to and fro within an inner cylinder 184, which fits snugly within an outer cylinder 186. Seals 187 are provided between the inner and outer cylinders 184 and 186 at opposite ends thereof. One end of the inner cylinder 184 is closed by an end closure member 188, which is formed with an outlet opening in the form of a longitudinal hydraulic fluid passage 190 opening, at one end, into the interior of the inner cylinder 184 and, at its opposite end, into a transverse hydraulic fluid passage 192. The end closure 188 is secured in position in the end of the inner cylinder 184 by a pair of grub screws 194, inserted through openings in the inner and outer cylinders 184 and 186 and in threaded engagement with the end closure member 188.

The piston 182 has, along its entire length, a diameter which corresponds, with a slight clearance to allow the sliding of the piston 182, to the internal diameter of the inner cylinder 184.

The external surface of the cylinder 184 is formed, along a portion of the length of the inner cylinder 184 adjacent the end containing the end closure 188, with a flat 196, which provides a recess in the external surface of the inner cylinder 184 and, thus, which provides a fluid passage extending longitudinally of the cylinders between the inner cylinder 184 and the outer cylinder 186.

A plurality of transversely extending hydraulic fluid outlet openings 198 are spaced-apart along the inner cylinder 184 and, when not blocked by the piston 182, provide communication between the interior of the inner cylinder 184 and the fluid passage formed by the flat 196, which in turn communicates with an outlet 200 through the outer cylinder 186.

The arrangement is such that, as the indexing arm 160 is pivoted for advancing the first arm structure 12 through each step of its rotation, the piston 182 is forced to the right, as viewed in the FIG. 14, by the indexing arm 160. During an initial portion of the movement of the piston 182 into the inner cylinder 184, hydraulic fluid can flow from the interior of the inner cylinder 184 through all of the outlet openings 198 to the common outlet opening 200. As the piston 182 continues to advance into the inner cylinder 184, the piston 182 successively blocks the openings 198 and, thus, the outflow of hydraulic fluid through the opening 200 is progressively reduced until, eventually the piston 182 blocks the right-hand opening 198, as viewed in FIG. 14. When that occurs, hydraulic fluid remaining in the inner cylinder 184 can escape only through the passage 190. Therefore, the movement of the piston 182 into the inner cylinder 184, and likewise the pivotal movement of the indexing arm 160, are subjected to a progressively increasing damping force as the index arm 160 reaches the end of its pivotal stroke.

Figure 15:
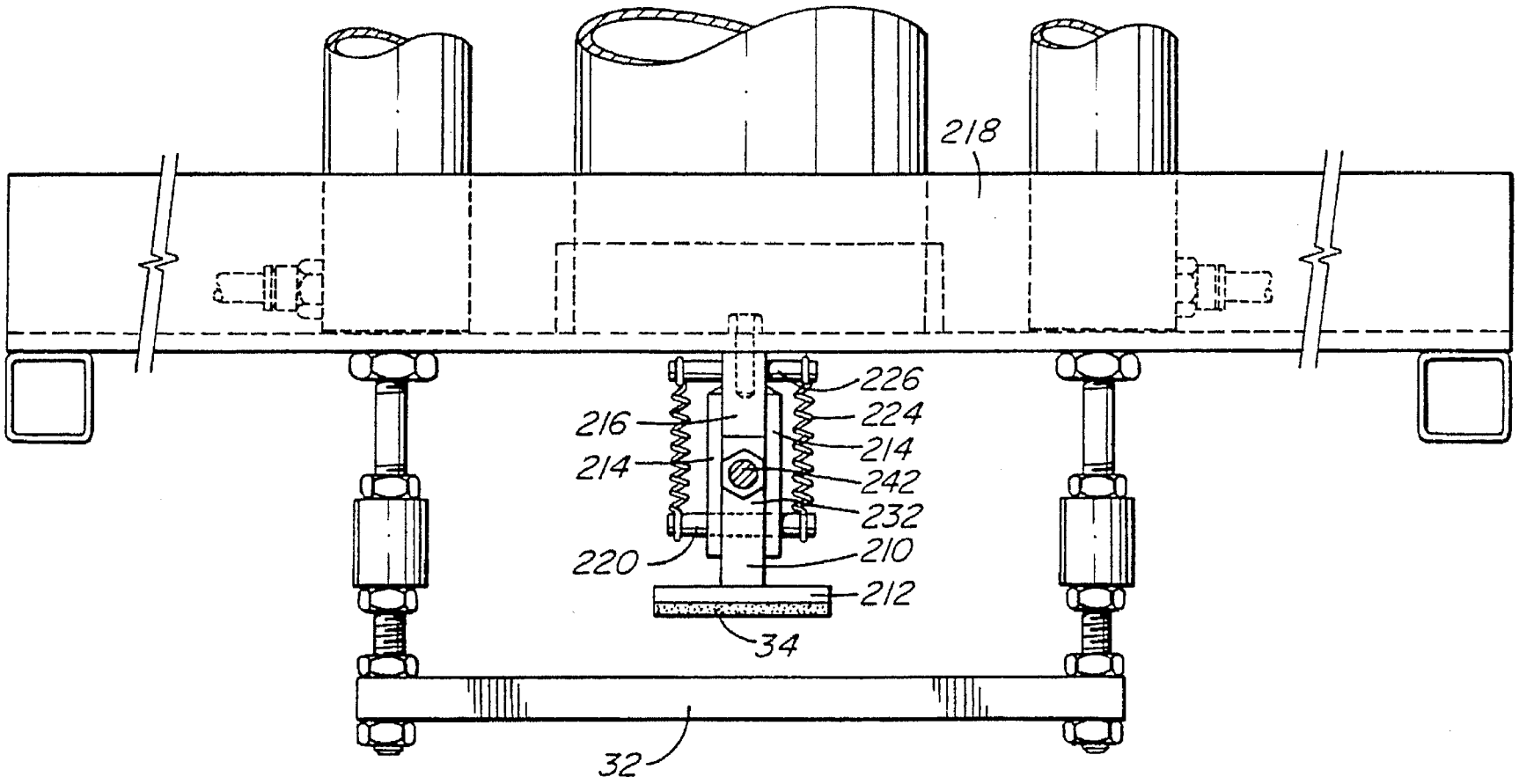
FIG. 15 shows a view in side elevation of parts of a fitting device of the machine of FIG. 1.
Figure 16:
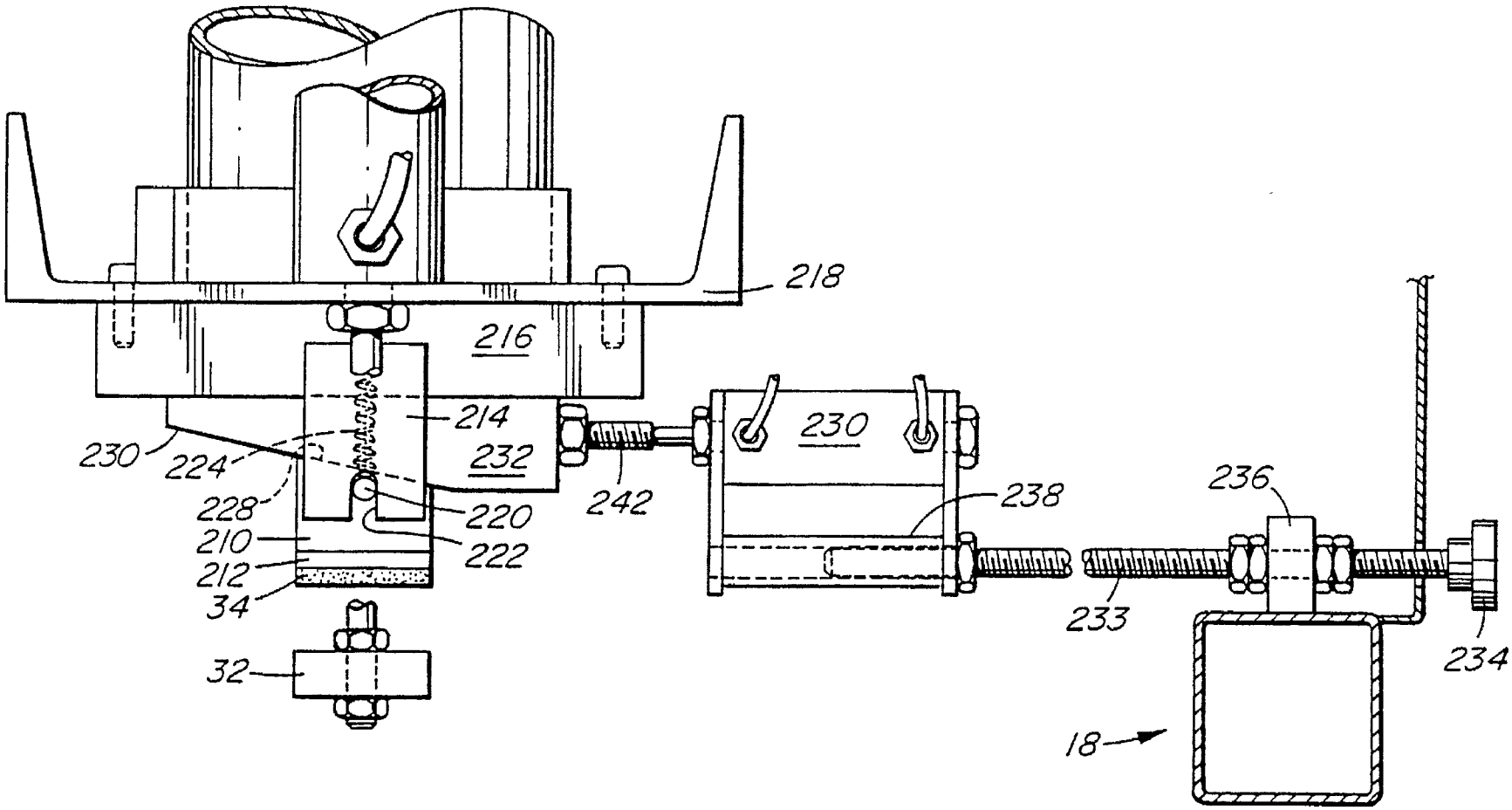
FIG. 16 shows a view, taken in the direction of arrow A of FIG. 15.

As described above with reference to FIG. 2, the upward displacement of the first arm structure 12 is limited by abutment of the crossbar 32 against the underside of the stop pad 34. FIGS. 15 and 16 illustrate a height adjustment mechanism for adjusting the height of the stop pad 34 and, thereby, for adjusting the height to which the first arm structure 12 can be raised by the piston and cylinder devices 30.

As shown in FIGS. 15 and 16, the stop pad 34 is provided with a vertical metal plate 210, which extends upwardly from a horizontal plate 212 on the underside of which the stop pad 34 is provided.

The plate 210 is vertically slidable between a pair of vertical slide plates 214, which extend downwardly from opposite sides of an elongate slide bar 216, which is secured to the underside of a horizontal beam 218 forming part of the machine frame 18.

A horizontal pin 220 extends from opposite sides of the plate 210 and is vertically slidable along vertical slots 222, of which only one is shown, in the side plates 214. A pair of tension springs 224, extending between opposite ends of the pin 220 and opposite ends of a further pin 226 projecting from opposite sides of the slide bar 216, resiliently urge the plate 210 in an upward direction.

The plate 210 is formed with an inclined upper edge 228, which abuts a correspondingly inclined edge 230 of a wedge member 232, which is displaceable to and fro along the slide bar 216.

A threaded spindle 233, provided at the one end with a manually adjustable member comprising a knob 234, which is readily accessible from the extension of the machine and is in threaded engagement with a block 236 secured to a part of the machine frame 18. The other end of the spindle 232 is in threaded engagement with a tube 238, which is secured to a pneumatic piston and cylinder device 230, which has a piston rod 242 connected to the wedge 232.

By operation of the piston and cylinder device 230, the wedge 232 can be displaced to and fro in order to correspondingly displace the stop pad 34 between an upper position and a lower position. The wedge 232 thus controls the locations of the raised and lowered positions of the first arm structure 12 on operation of the piston and cylinder devices 30.

In addition, by rotation of the knob 234, the wedge 232 can be adjusted in position along the slide bar 216 so as to correspondingly adjust the upper and lower limits of the vertical movement of the first arm structure 12.

Figures 17, 18:
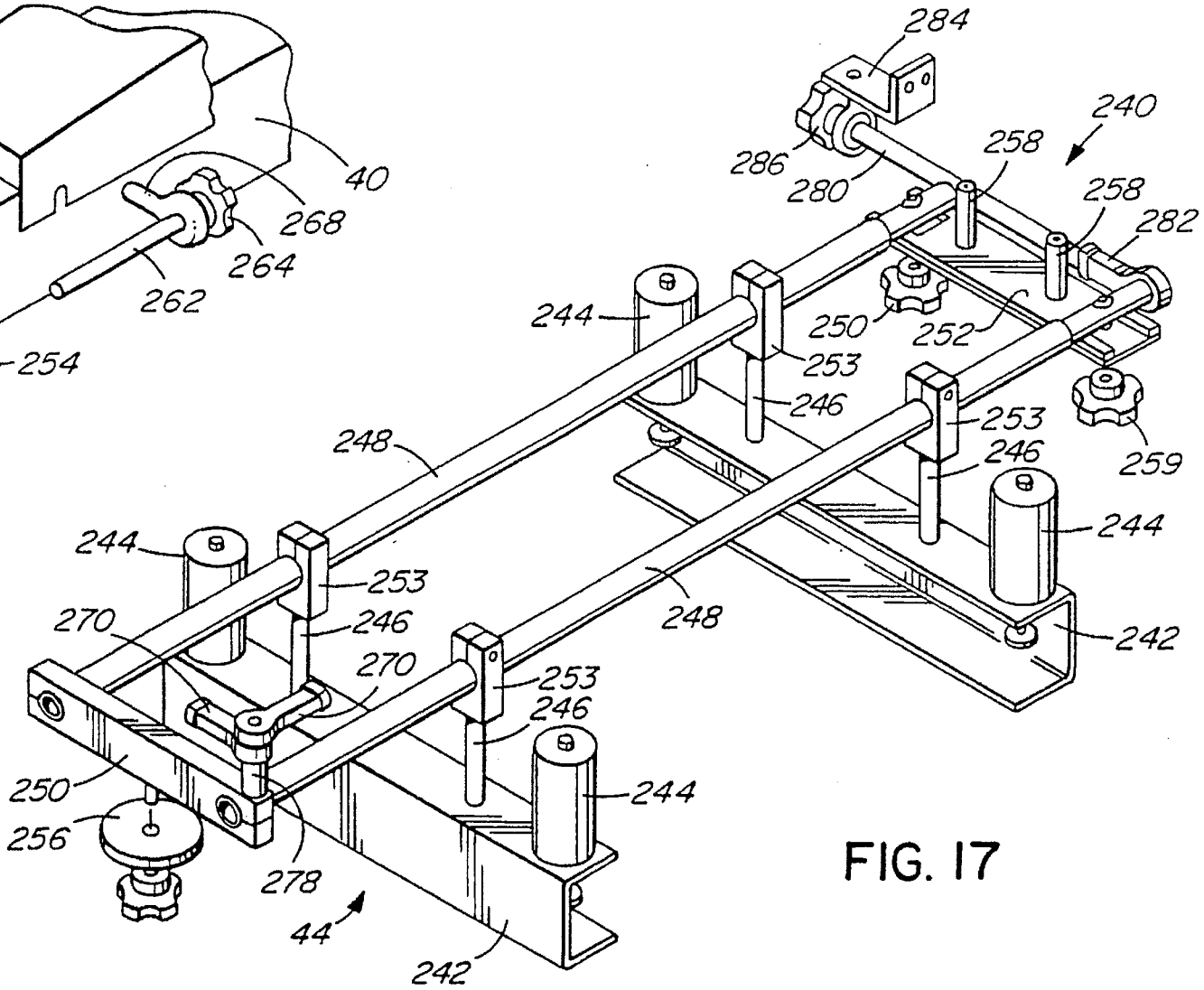
FIG. 17 shows a view in perspective of a printing screen holder and associated adjustment mechanism.
FIG. 18 shows a view in perspective of other parts of the screen holder adjustment mechanism on a broken-away end of one of the arms of the machine of FIG. 1.

Referring now to FIGS. 17 and 18, which show the print screen holder 44 and an adjustment mechanism, indicated generally by reference numeral 240, for adjusting the print screen holder 44 in position relative to its second arm 40, it will be seen that the holder 44 comprises a pair of spaced, mutually opposed print screen supports in the form of horizontally extending, laterally open channel members 242. The channel members 242 carry the screen 46 between them as shown in FIG. 2 and are each provided with a pair of pneumatically operably clamping devices 244 for clamping the printing screen 46 in position relative to the channel members 242.

The channel members 242 are carried by vertical rods 246 extending downwardly from a support structure comprising a support frame which is formed by a pair of parallel, horizontally extending elongate members in the form of rods 248 connected together at opposite ends by crossbars 250 and 252. The rods 246 are adjustably secured to the rods 248 by adjustable connectors in the form of damping devices 253.

The crossbar 250 can be clamped to a bracket 254, carried on the end of the arm 40, by means of a clamping device 256.

The crossbar 252 is secured to the underside of the arm 40 by a pair of retainers 258 and adjustably connected to the rods 248 by clamping devices 259. The adjustment mechanism 240 includes a pair of adjustment members in the form of spindles 260 and 262, provided with respective knobs 264 and in threaded engagement with respective supports 266 and 268 extending from the bracket 254 and one side of the arm 240, respectively, and pivotally connected by connector members 270 to a vertical pin 278 on one end of the crossbar 250.

The adjustment mechanism 240 also includes a further adjustment member comprising a threaded spindle 280 which is pivotally connected, by a connector member 282, to one end of one of the parallel rods 248, and extends in threaded engagement with a support bracket 284, which is fixed to the opposite side of the arm 40, the spindle 280 being provided with an operating knob 286.

On release of the clamping devices 256 and 259, and by appropriate adjustment of the knobs 264 and 286, the print screen holder 44 can be displaced longitudinally and transversely of the arm 40, and can be adjusted angularly, in a substantially horizontal plane, relative to the arm 40.

Referring again to FIG. 3, it will be seen that the bracket 254 at the end of the arm member 50 is provided, at its top, with an adjustment mechanism comprising an adjustment bolt 290, which is in threaded engagement with the bracket 254. The adjustment bolt 290 is in engagement with an outer end of the second arm member 52 so that, on loosening of the fasteners, comprising the bolts 58 and the nuts 56, the rotation of the adjustment bolt 290 can be employed to displace the second arm member 52 along a part of the length of the first arm member 50, for correspondingly adjusting the height of the latter, whereupon the bolts 58 can again be tightened.

The first and second arms 20 and 40 are provided with interengageable pairs of connectors indicated generally by reference numerals 300 and 302, at locations adjacent and radially inward of the printing screen supports 44. The connectors 300 and 302 are operable to forcibly connect the first arms 20 to the second arms 40 on displacement of the first arm structure 12 into its raised position.

The connectors 300 each comprise a pneumatic piston and cylinder device 304 having a downwardly extending piston rod 306 provided, at its lowermost end, with a flat disk-shaped head 308.

The connectors 302 each comprise a co-operating member in the form of a bracket 310 secured to opposite sides of the respective first arm 20 and formed with opposed horizontal openings 312 for the passage of the head 308 through the bracket 310 and, at the top of the bracket 310, a slot 314 for the passage of the piston rod 306.

Figure 19:
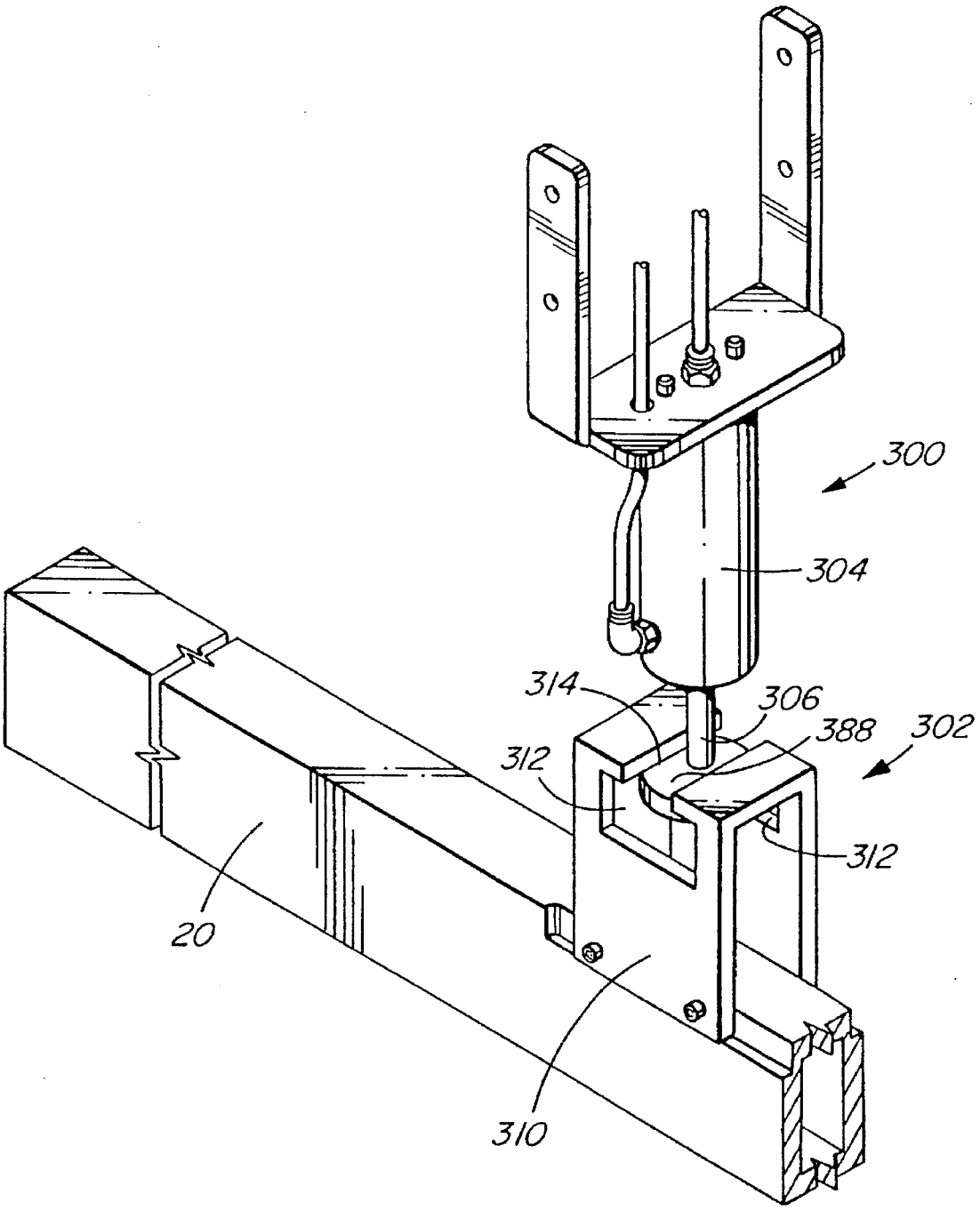
FIG. 19 shows a broken-away view, in perspective, of a connector arrangement forming part of the machine of FIG. 1.

When the arms 20 come to rest beneath the arms 40, each connector head 308 is located within the respective brackets 310, as illustrated in FIG. 19. The piston and cylinder devices 304 are then retracted to engage the tops of the heads 308 with the brackets 310 to forcibly connect the arms 20 to the arms 40 and, thereby, to raise the first arms 20 towards the second arms 40 so as to counteract any bending of the first arms 20 during the operation of the squeegee mechanisms 48.

As will be readily apparent to those skilled in the art, various modifications may be made in the above-described machine within the scope and spirit of the appended claims.

I claim:

1. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carried on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position; and interengageable pairs of connectors provided on said first and second arms, respectively, at locations adjacent and radially inward of said printing screen supports and operable to forcibly connect said first arms to said second arms on displacement of said first arm structure into the raised position, and thereby to counteract bending of said arms during the operation of said squeegee mechanisms.

2. A screen printing machine as claimed in claim 1, wherein said pairs of connectors each comprise a piston and cylinder device carried on one of said second arms and having a downwardly extending piston rod and a head carded by a lowermost end of said piston rod, and a co-operating member on one of said first arms, said co-operating member having a horizontal opening for movement of said head into and beyond said co-operating member during the rotation of said first arm structure and a slot extending upwardly from said opening for receiving said piston rod, said head being engageable with said co-operating member by retraction of said piston and cylinder device.

3. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carried on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position;

suspension arrangements supporting said squeegee mechanisms from said second arms for movement to and fro over the printing screens;

piston and cylinder devices connected between said suspension arrangements and said first arms for effecting the to and for movement of said squeegee mechanisms; and air brakes for braking the to and fro movement of said squeegee mechanisms, said piston and cylinder devices including piston rods extending through said air brakes and said air brakes each comprising a pair of brake members formed with cylindrically curved braking surfaces at opposite sides of a respective one of said piston rods and air passages for supplying compressed air to said brake members so as to urge said braking surfaces into frictional braking contact with the opposite sides of respective one of said piston rods.

4. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carried on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position;

interengageable pairs of connectors provided on said first and second arms, respectively, at locations adjacent and radially inward of said printing screen supports and operable to forcibly connect said first arms to said second arms on displacement of said first arm structure into the raised position, and thereby to counteract bending of said arms during the operation of said squeegee mechanisms;

a stop mounted on said support structure for limiting the upward movement of said first arm structure towards said second arm structure;

a height adjustment mechanism connected to said stop for adjustably raising and lowering said stop and thereby adjusting the limit of the upward movement of said first arm structure; and said height adjustment mechanism including a manually adjustable member, which is readily accessible from the exterior of said screen printing machine, for operating said height adjustment mechanism.

5. A screen printing machine as claimed in claim 4, wherein said height adjustment mechanism further comprises a piston and cylinder device operable to displace said stop between raised and lowered positions for determining corresponding raised and lowered position of said first arm structure.

6. A screw printing machine as claimed in claim 5, wherein said height adjustment mechanism includes a threaded spindle carrying said manually adjustable member at one end thereof and said piston and cylinder device includes a threaded portion in threaded engagement with said threaded spindle, whereby rotation of said manually adjustable member is effective to displace said piston and cylinder device and, thereby, to adjust the height of said stop.

7. A screen printing machine as claimed in claim 6, wherein said height adjustment mechanism comprises a wedge co-operating with said stop and a wedge adjustment mechanism for displacing said wedge relative to said stop so as to correspondingly vary the location of said stop, said wedge adjustment mechanism comprising a piston and cylinder device operable to displace said wedge to and fro and thereby to displace said stop between raised and lowered positions, and an adjustable connection between said manually adjustable member and said piston and cylinder device and operable to displace said piston and cylinder device and therewith said wedge member in response to adjustment of said manually adjustable member.

8. A screen printing machine as claimed in claimed 4, wherein said height adjustment mechanism comprises a wedge co-operating with said stop and said manually adjustable member forms part of a wedge adjustment mechanism for displacing said wedge relative to said stop so as to correspondingly vary the vertical location of said stop.

9. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carried on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position;

interengageable pairs of connectors provided on said first and second arms, respectively, at locations adjacent and radially inward of said printing screen supports and operable to forcibly connect said first arms to said second arms on displacement of said first arm structure into the raised position, and thereby to counteract bending of said arms during the operation of said squeegee mechanisms;

a shock absorber connected between said support structure and said indexing mechanism; and said shock absorber comprising a cylinder, an elongate piston slidable to and fro in said cylinder and a plurality of fluid outlet openings spaced apart along said cylinder for permitting hydraulic fluid to escape from said cylinder in response to sliding of said piston within said cylinder towards one end of said cylinder, and said piston being dimensioned to successively block said outlet openings as said piston slides into said cylinder.

10. A screen printing machine as claimed in claim 9, wherein said outlet openings are distributed over a predetermined length of said cylinder and said piston has a diameter substantially equal to the internal diameter of said cylinder so that said piston can simultaneously block said outlet openings, said cylinder including a further outlet openings at said one end of said cylinder.

11. A screen printing mechanism as claimed in claim 10, wherein said cylinder is an inner cylinder and said shock absorber further comprises an outer cylinder, said inner cylinder fitting snugly into said outer cylinder, and further comprising seals between said inner and outer cylinders at opposite ends thereof, said outer cylinder having an outlet for the hydraulic fluid and said inner cylinder having an external recess communicating with said outlet openings in said inner cylinder and with said outlet in said outer cylinder.

12. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carried on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position;

interengageable pairs of connectors provided on said first and second arms, respectively, at locations adjacent and radially inward of said printing screen supports and operable to forcibly connect said first arms to said second arms on displacement of said first arm structure into the raised position, and thereby to counteract bending of said arms during the operation of said squeegee mechanisms; and said indexing mechanism comprising an indexing arm mounted for pivotation about said vertical support and having a free end, a piston and cylinder device connected between said indexing arm and said support structure for effecting pivotation of said indexing arm; a connector member at the free end of said indexing arm and an actuator on said free end of said indexing arm for raising said connector member into drive transmitting engagement with successive ones of said first arms.

13. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carried on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position;

interengageable pairs of connectors provided on said first and second arms, respectively, at locations adjacent and radially inward of said printing screen supports and operable to forcibly connect said first arms to said second arms on displacement of said first arm structure into the raised position, and thereby to counteract bending of said arms during the operation of said squeegee mechanisms;

said printing screen supports each comprising a screen holder for holding a printing screen; a support arrangement carrying said screen holder; and an adjustment mechanism between said support arrangement and the respective one of said second arms, said adjustment mechanism comprising means for adjustably displacing said support arrangement longitudinally and transversely of its respective second arm;

said screen holder comprising a pair of spaced screen supports for supporting opposite edges of the printing screen; and said support arrangement being provided with adjustable connectors between said screen supports and said support arrangement to allow said screen supports to be adjusted in position relative to one another and to said support arrangement.

14. A screen printing machine as claimed in claim 13, wherein said support arrangement comprises a pair of parallel, substantially horizontal elongate members extending along the respective one of said second arms and said adjustable connectors are adjustably slidable along said elongate members.

15. A screen printing machine as claimed in claim 14, wherein said elongate members comprise opposite sides of a support frame, and said adjustment mechanism comprises means for adjusting said support frame angularly relative to the respective one of said second arms.

16. A screen printing machine as claimed in claim 13, wherein adjusting means comprise a pair of adjustment members spaced apart along the respective second arm and operable to displace said screen support transversely of the respective second arm and a further adjustment member operable to displace said screen support longitudinally of the respective second arm.

17. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carried on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position;

interengageable pairs of connectors provided on said first and second arms, respectively, at locations adjacent and radially inward of said printing screen supports and operable to forcibly connect said first arms to said second arms on displacement of said first arm structure into the raised position, and thereby to counteract bending of said arms during the operation of said squeegee mechanisms; and said second arms each comprising a first arm member extending radially outwardly of said vertical support, a second arm member extending radially outwardly of said vertical support and downwardly and outwardly inclined towards said first arm member, releasable fasteners for securing said second arm member to said first arm member and an adjustment mechanism connected between said first and second arm members and adjustable to displace said second arm member in position along said first arm member while said fasteners are released.

18. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carried on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position;

interengageable pairs of connectors provided on said first and second arms, respectively, at locations adjacent and radially inward of said printing screen supports and operable to forcibly connect said first arms to said second arms on displacement of said first arm structure into the raised position, and thereby to counteract bending of said arms during the operation of said squeegee mechanisms; and said squeegee mechanisms each comprising a squeegee which is slidable in contact with one of the printing screens; a carriage movable along a respective one of said second arms and carrying said squeegee for movement to and fro over the printing screen, said squeegee having a pair of mutually angularly disposed squeegee blades, and a pivotal connection between said squeegee and said carriage, said pivotal connection permitting pivotation of said squeegee about an axis parallel to said squeegee blades for bringing said squeegee blades alternately into contact with said printing screen during the to and fro moments, respectively, of said carriage; a piston and cylinder device mounted on said carriage and connected to said carriage and said squeegee, said piston and cylinder device being operable to pivot said squeegee about said axis, and an adjustable stop mechanism adjustably limiting the pivotation of said squeegee by said piston and cylinder device.

19. A screen printing machine as claimed in claim 18, wherein said piston and cylinder device comprises a piston rod connected to said squeegee and a cylinder connected to said carriage and wherein said adjustable stop mechanism comprises an elongate member extending parallel to said piston and cylinder device and connected to said piston rod for movement therewith, an abutment fixed relative to said cylinder and a pair of stop members carried by said elongate member and adjustable in position along said elongate member, said stop members being movable into contact with said abutment, in response to extension and retraction of said piston rod, so as to limit the range of movement of said piston rod.

20. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carded on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position;

interengageable pairs of connectors provided on said first and second arms, respectively, at locations adjacent and radially inward of said printing screen supports and operable to forcibly connect said first arms to said second arms on displacement of said first arm structure into the raised position, and thereby to counteract bending of said arms during the operation of said squeegee mechanisms; and said squeegee mechanism including a squeegee which is slidable in contact with one of the printing screens, a carriage movable along a respective one of said second arms and carrying said squeegee for movement to and fro over said printing screen and a vertically adjustable connection between said squeegee and said carriage, said vertically adjustable connection comprising a cylindrical threaded member extending downwardly from said carriage, a manually rotatable adjustment ring member in threaded engagement with said cylindrical threaded member, and a slide member carrying said squeegee, said slide member being supported on said ring member for vertical displacement upon rotation of said ring member about said cylindrical threaded member.

21. A screen printing machine, comprising:

a support structure for supporting said machine on a floor;

said support structure comprising a vertical support having a vertical axis;

a first arm structure;

a bearing arrangement co-axial with said vertical cylindrical support and supporting said first arm structure for rotation about the vertical axis;

said first arm structure comprising a plurality of first arms equiangularly distributed about the vertical axis;

said first arms extending radially outwardly of said vertical axis and having free outer ends;

printing screen support platens carried on said free outer ends of said first arms;

a second arm structure mounted on said vertical support above said first arm structure;

said second arm structure comprising a plurality of second arms equiangularly distributed about said vertical axis;

said second arms extending radially outwardly of said vertical axis above said first arm structure and having free outer ends;

said second arms carrying, at said free outer ends thereof, squeegee mechanisms and printing screen supports for holding printing screens below said squeegee mechanisms;

an indexing mechanism connected between said first arm structure and said support structure and operable to rotate said first arm structure stepwise around the vertical axis so as to position said printing screen support platens in succession in registry with said squeegee mechanisms;

a lifting device connected between said first arm structure and said support structure and operable to displace the former to and from a raised position;

interengageable pairs of connectors provided on said first and second arms, respectively, at locations adjacent and radially inward of said printing screen supports and operable to forcibly connect said first arms to said second arms on displacement of said first arm structure into the raised position, and thereby to counteract bending of said arms during the operation of said squeegee mechanisms;

said screen printing machine further comprising:

suspension arrangements supporting said squeegee mechanisms from said second arms for movement to and fro over the printing screens;

piston and cylinder devices connected between said suspension arrangements and said first arms for effecting the to and for movement of said squeegee mechanisms; and air brakes for braking the to and fro movement of said squeegee mechanisms, said piston and cylinder devices including piston rods extending through said air brakes and said air brakes each comprising a pair of cylindrically curved brake members at opposite sides of a respective one of said piston rods and air passages for supplying compressed air to said brake members so as to urge said brake members against the opposite sides of respective one of said piston rods;

a stop mounted on said support structure for limiting the upward movement of said first arm structure towards said second arm structure;

a height adjustment mechanism connected to said stop for adjustably raising and lowering said stop and thereby adjusting the limit of the upward movement of said first arm structure; and said height adjustment mechanism including a manually adjustable member, which is readily accessible from the exterior of said screen printing machine, for operating said height adjustment mechanism;

a shock absorber connected between said support structure and said indexing mechanism;

said shock absorber comprising a cylinder, an elongate piston slidable to and fro in said cylinder and a plurality of fluid outlet openings spaced apart along said cylinder for permitting hydraulic fluid to escape from said cylinder in response to sliding of said piston within said cylinder towards one end of said cylinder, and said piston being dimensioned to successively block said outlet openings as said piston slides into said cylinder;

said indexing mechanism comprising an indexing arm mounted for pivotation about said vertical support and having a free end, a piston and cylinder device connected between said indexing arm and said support structure for effecting pivotation of said indexing arm; a connector member at the free end of said indexing arm and an actuator on said free end of said indexing arm for raising said connector member into drive transmitting engagement with successive ones of said first arms;

said printing screen supports each comprising a screen holder for holding a printing screen; a support arrangement carrying said screen holder; and an adjustment mechanism between said support arrangement and the respective one of said second arms, said adjustment mechanism comprising means for adjustably displacing said support arrangement longitudinally and transversely of its respective second arm;

said screen holder comprising a pair of spaced screen supports for supporting opposite edges of the printing screen;

said support arrangement being provided with adjustable connectors between said screen supports and said support arrangement to allow said screen supports to be adjusted in position relative to one another and to said support arrangement;

said second arms each comprising a first arm member extending radially outwardly of said vertical support, a second arm member extending radially outwardly of said vertical support and downwardly and outwardly inclined towards said first arm member, releasable fasteners for securing said second arm member to said first arm member and an adjustment mechanism connected between said first and second arm members and adjustable to displace said second arm member in position along said first arm member while said fasteners are released;

said squeegee mechanisms each comprising a squeegee which is slidable in contact with one of the printing screens; a carriage movable along a respective one of said second arms and carrying said squeegee for movement to and fro over the printing screen, said squeegee having a pair of mutually angularly disposed squeegee blades, and a pivotal connection between said squeegee and said carriage, said pivotal connection permitting pivotation of said squeegee about an axis parallel to said squeegee blades for bringing said squeegee blades alternately into contact with said printing screen during the to and fro moments, respectively, of said carriage; a piston and cylinder device mounted on said carriage and connected to said carriage and said squeegee, said piston and cylinder device being operable to pivot said squeegee about said axis, and an adjustable stop mechanism adjustably limiting the pivotation of said squeegee by said piston and cylinder device; and said squeegee mechanism including a squeegee which is slidable in contact with one of the printing screens, a carriage movable along a respective one of said second arms and carrying said squeegee for movement to and fro over said printing screen and a vertically adjustable connection between said squeegee and said carriage, said vertically adjustable connection comprising a cylindrical threaded member extending downwardly from said carriage, a manually rotatable adjustment ring member in threaded engagement with said cylindrical threaded member, and a slide member carrying said squeegee, said slide member being supported on said ring member for vertical displacement upon rotation of said ring member about said cylindrical threaded member.

* * * * *